US008863643B2

(12) United States Patent
Powell

(10) Patent No.: US 8,863,643 B2
(45) Date of Patent: Oct. 21, 2014

(54) CO-AXIAL CRANKLESS ENGINE

(76) Inventor: Darren Powell, Aylmerton (AU)

( * ) Notice: Subject to any disclaimer, the term of this patent is extended or adjusted under 35 U.S.C. 154(b) by 557 days.

(21) Appl. No.: 13/264,730

(22) PCT Filed: Mar. 19, 2010

(86) PCT No.: PCT/AU2010/000324

§ 371 (c)(1),
(2), (4) Date: Oct. 14, 2011

(87) PCT Pub. No.: WO2010/118457

PCT Pub. Date: Oct. 21, 2010

(65) Prior Publication Data

US 2012/0024147 A1 Feb. 2, 2012

(30) Foreign Application Priority Data

Apr. 16, 2009 (AU) ..... 2009901630

(51) Int. Cl.

| | |
|---|---|
| ***F01B 3/00*** | (2006.01) |
| ***F01B 13/04*** | (2006.01) |
| ***F01B 7/02*** | (2006.01) |
| ***F01B 7/12*** | (2006.01) |
| ***F02B 75/28*** | (2006.01) |
| ***F02B 75/26*** | (2006.01) |
| ***F01B 3/04*** | (2006.01) |

(52) U.S. Cl.

CPC ..... *F02B 75/26* (2013.01); *F02B 75/282* (2013.01); *F01B 3/045* (2013.01)

USPC ..... 91/501; 92/75; 92/69 R

(58) Field of Classification Search

USPC ..... 91/501; 92/75, 69 R

See application file for complete search history.

(56) References Cited

U.S. PATENT DOCUMENTS

| | | | | |
|---|---|---|---|---|
| 1,876,506 | A * | 9/1932 | Lee | 92/70 |
| 1,987,699 | A * | 1/1935 | Moore | 60/624 |
| 5,031,581 | A * | 7/1991 | Powell | 123/51 B |

* cited by examiner

*Primary Examiner* — Edward Look
*Assistant Examiner* — Daniel Collins
(74) *Attorney, Agent, or Firm* — Birch, Stewart, Kolasch & Birch, LLP

(57) ABSTRACT

A co-axial crankless engine (1) having at least one cylinder (3) defining a longitudinally extending axis (XX). A pair of pistons (5, 6) are positioned to reciprocate in opposite directions along the longitudinal axis of the cylinder. A space (7) between the pistons defines a common combustion chamber (70). A first shaft (10) is positioned substantially parallel to and spaced laterally from the longitudinal axis of the cylinder. A second shaft (12) is positioned substantially parallel to and spaced laterally from the longitudinal axis of the cylinder. The second shaft (12) has a longitudinally extending bore (14) through which the first shaft can extend and rotate. Each piston is connected to an axially spaced cam (16, 17). A first cam being supported by the first shaft, a second cam being supported by the second shaft. In use, reciprocation of the pistons imparts on respective shafts rotating motion in opposite directions to drive the engine.

14 Claims, 1 Drawing Sheet

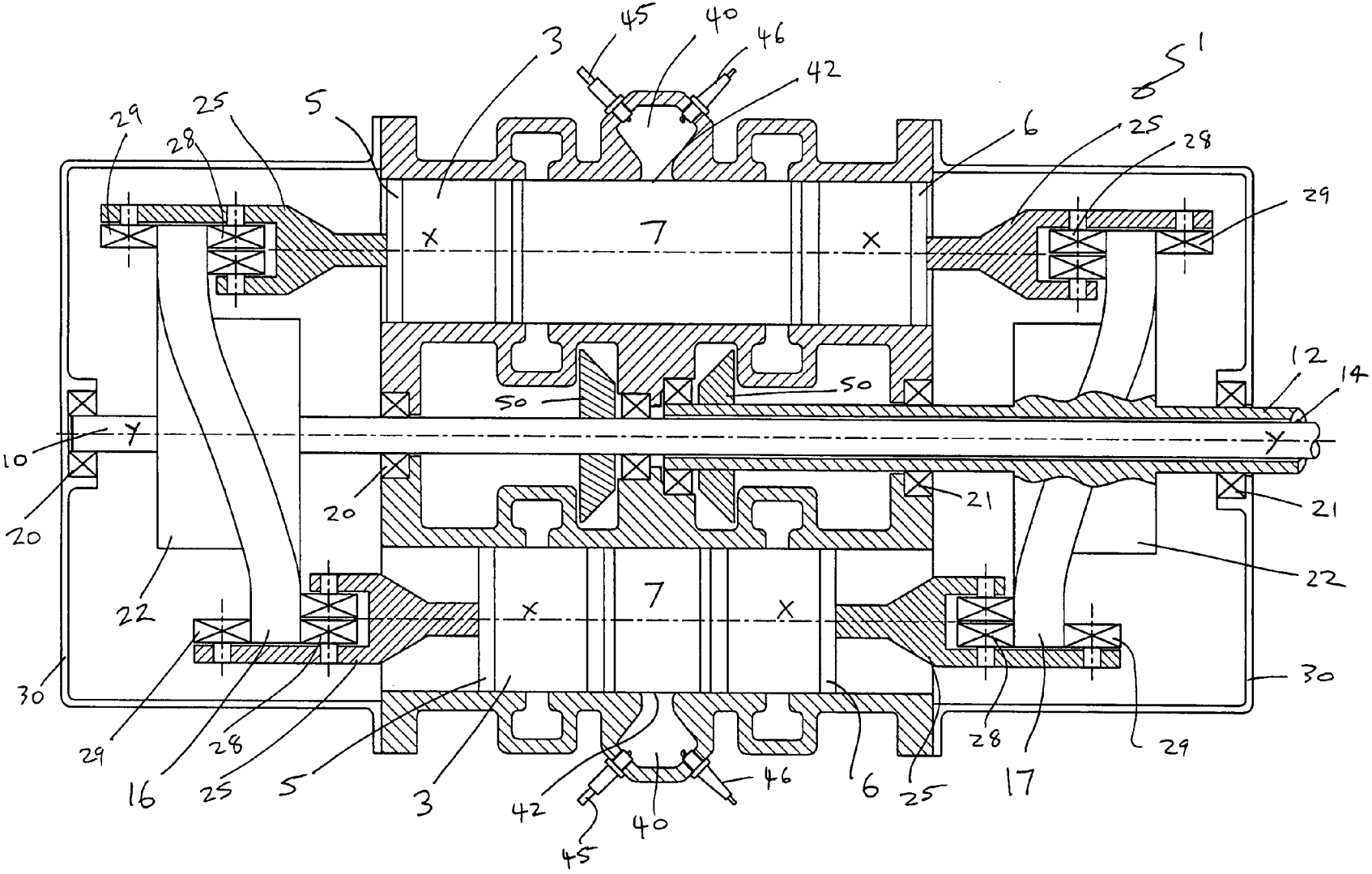
1
29
28
25
6
42
46
40
45
3
5
7
50
12
14
21
22
30
17
16
20
10

CO-AXIAL CRANKLESS ENGINE

FIELD OF THE INVENTION

The present invention relates to engines to do work and in particular to a co-axial/bi-directional crankless engine.

BACKGROUND OF THE INVENTION

Reciprocating engines are common throughout the world and typically use a crank mechanism to convert reciprocating motion into rotary motion to drive a machine such as a vehicle. Due to the reciprocating nature of such engines, energy is lost during motion which reduces the efficiency of the engine and causes imbalances which result in wear of the components, unavoidable vibration of components and excessive noise.

There have been a number of attempts at addressing these issues. For example: rotary engines, orbital engines, split cycle engines, cam engines, axial engines, barrel engines—all representing engines whereby the crankshaft has been replaced by some other mechanism to convert reciprocating motion to rotational motion where many of the problems associated with the inherently out-of-balance crankshaft are alleviated to some extent.

Such engines can drive machines which include blades or rotors or the like at the end of a drive shaft to propel the machine (for example, a boat, plane, submarine, helicopter or the like). Especially in military machines, co-axial rotors have been utilized to turn a pair of rotors or propellers in opposite directions but are mounted on a single shaft with the same axis of rotation except for contra-rotating devices where the rotors or propellers are rotating on separate shafts on separate axes in opposite directions. Either configuration requires a gearbox of some description to convert a single shaft operation to two counter-rotating or coaxial shafts. A planetary gearset or similar gearbox is employed to convert the rotation of the drive shaft from the engine to a co-axial or counter-rotating shaft arrangement to drive the co-axial or counter-rotating propellers or rotors. Such systems are found in marine craft, for example. The two propellers or rotors are arranged one behind the other and the power is transferred from the engine via the gear transmission. There is a reduction in rotational flow providing a maximum amount of air or water uniformly through the propellers or rotors providing higher performance and less energy loss. Such systems also reduce or eliminate the amount of torque created by existing single propeller and rotor systems. However, these engines and associated transmission systems are typically expensive, mechanically complex, weigh more, cost more to maintain, are noisy and are prone to failure. For example, in a co-axial helicopter, the gearbox and rotor hub are extremely complicated with many linkages, plates and other parts that can fail due to the need to drive two rotor disks in opposite directions simultaneously.

It was suggested in AU 629,238 (the contents of which are incorporated herein by reference) engine complexity could be reduced by providing a crankless reciprocating engine. Such an engine could comprise at least one cylinder, two opposed pistons arranged to reciprocate in opposite directions along the longitudinal axis of each cylinder, the pistons defining a common combustion chamber therebetween, a main shaft disposed parallel to, and spaced from, the longitudinal axis of each cylinder, and two axially spaced, endless, substantially sinusoidal tracks carried by the main shaft for rotation therewith, said tracks being interconnected with said pistons so that reciprocation of the pistons imparts rotary motion to the main shaft. The engine further comprises a small charge and ignition chamber in communication with the common combustion chamber, means to admit fuel into the charge and ignition chamber to form a fuel rich charge therein and to form with air in the common combustion chamber a fuel lean charge therein. An ignition device is located in the charge and ignition chamber for ignition of the fuel rich charge therein.

However, with the above proposed engine there is still a need to resolve the problems associated with spinning two shafts concentrically in opposite directions on the same axis and problems with wear and complexity. Also, a gear box is required to convert the power and torque being delivered from a single shaft engine as discussed above to co-axial power.

Accordingly, there is a need to provide an engine which delivers full power and torque at the required RPM of the machine to concentric, coaxial shafts without the need for a gearbox.

OBJECT OF THE INVENTION

It is an object of the present invention to substantially overcome or at least ameliorate one or more of the disadvantages of the prior art, or to at least provide a useful alternative.

SUMMARY OF THE INVENTION

There is firstly disclosed herein a co-axial crankless engine having:

at least one cylinder defining a longitudinally extending axis;

a pair of pistons positioned to reciprocate in opposite directions along the longitudinal axis of said cylinder, a space between said pistons defining a common combustion chamber;

a first shaft positioned substantially parallel to and spaced laterally from the longitudinal axis of said cylinder;

a second shaft positioned substantially parallel to and spaced laterally from the longitudinal axis of said cylinder, said second shaft having a longitudinally extending bore through which said first shaft can extend and rotate, each said piston being connected to an axially spaced cam, a first said cam being supported by said first shaft, a second said cam being supported by said second shaft, whereby in use reciprocation of said pistons imparts on respective shafts rotating motion in opposite directions to drive said engine.

Preferably, including a plurality of cylinders located about the shafts.

Preferably, including two cylinders and four pistons, the pistons in one cylinder operating 180° out of phase with the pistons in the other cylinder.

Preferably, including three cylinders and six pistons arranged in a delta formation equally spaced about the shafts.

Preferably, including four or more cylinders.

Preferably, the cams are mirror images of each other.

Preferably, the cams are single lobe, multi-lobe, swash plate, wobble plate or sinusoidal cams.

Preferably, the pistons in opposite cylinders located on the same side of the engine as each other are connected to the same cam.

Preferably, the pistons drive the cams in opposition directions creating coaxial counter-rotation of the shafts.

Preferably, the first shaft is supported by a first frame, the second shaft being supported by a second frame.

Preferably, including a first gear operatively associated with said first shaft.

Preferably, including a second gear operatively associated with said second shaft.

Preferably, the first and second gears attached to said shafts are linked by means to ensure timing synchronisation between the shafts.

Preferably, said means is a gear which provides a drive for a power take-off shaft at about 90° to the first and second shafts.

BRIEF DESCRIPTION OF THE DRAWING

A preferred embodiment of the invention will now be described, by way of example only, with reference to the accompanying drawing, wherein:

FIG. 1 is a cross-sectional side view of an embodiment of the invention.

DETAILED DESCRIPTION OF THE PREFERRED EMBODIMENTS

In FIG. 1 there is disclosed a coaxial crankless engine 1 having at least one cylinder 3 defining a longitudinal axis XX. A pair of pistons 5, 6 are positioned to reciprocate in opposite directions along the longitudinal axis XX of the cylinder 3. A space 7 between the pistons 5 defines a common combustion chamber 7. A first shaft 10 is positioned substantially parallel to and laterally spaced from the longitudinal axis XX of the cylinder 3. A second shaft 12 is also positioned substantially parallel to and laterally spaced from the longitudinal axis XX of the cylinder 3. The second shaft 12 has a longitudinally extending bore 14 through which the first shaft 10 can extend and rotate. The first shaft 10 rotates in the opposite direction to the second shaft 12. The pistons 5, 6 are connected to two axially spaced endless cams 16, 17. The first cam 16 is supported by the first shaft 10 and connected to the piston 5. The second cam 17 is supported by the second shaft 12 and connected to the piston 6. In use, reciprocation of the pistons 5, 6 imparts on respective shafts 10, 12 rotating motion in opposite directions to drive the engine 1.

The basic operation of the engine shown in FIG. 1 acts like a typical internal combustion engine. However, the engine 1 comprises two cylinders 3 disposed on opposite sides of the first shaft 10 and second shaft 12 which are mounted for rotation in opposite directions about the horizontal axis XX in bearings 20 and 21. Herein, the terms "axial" and "radial" have reference to the longitudinal axis YY of first and second shafts 10, 12. Fixed to the first shaft 10 and the second shaft 12 for rotation therewith is a pair of spaced wheels 22 having similar outer cylindrical surfaces. Each wheel 22 supports the cams 16, 17 which extend radially outwardly from the cylindrical surface of the respective wheel 22. The cams 16, 17 are contoured in an axial direction so that they trace an endless path around the cylindrical surface of wheels 22. In the preferred form, the cams 16, 17 can be lobe cam profiles, swash plates, wobble plates, sinusoidal cams or such shapes which convert reciprocating motion to rotational motion to drive shafts 10, 12. The two cams 16, 17 are identical, one being the mirror image of the other.

Each cylinder 3 and its reciprocating pistons 5, 6 are of the same construction. However, referring to FIG. 1 the pistons 5, 6 in the top cylinder 3 operate 180° out of phase with the pistons 5, 6 in the bottom cylinder 3. The opposed pistons 5, 6 are adapted to reciprocate in opposite directions along the longitudinal axis XX of cylinder 3. Rigidly or pivotally connected to each piston 5, 6 is a connecting rod 25 which is adapted to co-operate with the cams 16, 17 by way of one, two or more drive bearings 28 and a tail bearing 29. The engine is closed at each end by sump casing 30. Any number of bearings may be utilized.

As shown in FIG. 1, the distal end of connecting rod 25 is bifurcated to provide a mounting for one, two or more drive bearing 28 on each arm. The outer of the bifurcated arms extends beyond the cam 16 to provide a mounting for tail bearing 29.

Pistons 5, 6 define a common combustion chamber 7 therebetween. Mounted adjacent to each cylinder 3 is a charge and ignition chamber 40 (fuel rich chamber) provided with an orifice 42 for communication with the combustion chamber 7. A spark plug 45 is mounted on chamber 40 for ignition of fuel therein. A fuel injector 46 controls the admission of fuel into the charge and ignition chamber 40. The combustion process in the engine would typically be like an existing engine and can also be compression ignition as required.

The engine 1 may also include gears 50 or the like. The gears 50 are bevel or hypoidal gears which marry to a common straight bevel or hypoidal gear (not shown) sitting directly on top of gears 50 and the first and second shafts 10, 12 locking the rotation of the co-axial shafts 10, 12 together. The gear (not shown) also provides power take-off to an ancillary shaft at 90° to the co-axial shafts 10, 12. This shaft arrangement can be duplicated around the engine 1 as required. The gear design may vary depending on the requirements for rotation speed, degree of gear reduction and torque loading of the ancillary device it is driving such as a pusher propeller and by varying the timing of this gearing system, yaw control may be improved in some applications.

Although the invention has been described with reference to specific examples, it will be appreciated by those skilled in the art that the invention may be embodied in many other forms.

The invention claimed is:

1. A co-axial crankless engine having:

at least one cylinder defining a longitudinally extending axis;

a pair of pistons positioned to reciprocate in opposite directions along the longitudinal axis of said cylinder, a space between said pistons defining a common combustion chamber;

a first shaft positioned substantially parallel to and spaced laterally from the longitudinal axis of said cylinder;

a second shaft positioned substantially parallel to and spaced laterally from the longitudinal axis of said cylinder, said second shaft having a longitudinally extending bore through which said first shaft can extend and rotate, each said piston being connected to an axially spaced cam, a first said cam being supported by said first shaft, a second said cam being supported by said second shaft, whereby in use reciprocation of said pistons imparts on respective shafts rotating motion in opposite directions to drive said engine.

2. The co-axial crankless engine according to claim 1, further including a plurality of cylinders located about the shafts.

3. The co-axial crankless engine according to claim 1, further including two cylinders and four pistons, the pistons in one cylinder operating 180° out of phase with the pistons in the other cylinder.

4. The co-axial crankless engine according to claim 1, further including three cylinders and six pistons arranged in a delta formation equally spaced about the shafts.

5. The co-axial crankless engine according to claim 1, further including four or more cylinders.

6. The co-axial crankless engine according to claim 1, wherein the cams are mirror images of each other.

7. The co-axial crankless engine according to claim 1, wherein the cams are single lobe, multi-lobe, swash plate, wobble plate or sinusoidal cams.

8. The co-axial crankless engine according to claim 1, wherein the pistons in opposite cylinders located on the same side of the engine as each other are connected to the same cam.

9. The co-axial crankless engine according to claim 1, wherein the pistons drive the cams in opposition directions creating coaxial counter-rotation of the shafts.

10. The co-axial crankless engine according to claim 1, wherein the first shaft is supported by a first frame, the second shaft being supported by a second frame.

11. The co-axial crankless engine according to claim 1, further including a first gear operatively associated with said first shaft.

12. The co-axial crankless engine according to claim 1, further including a second gear operatively associated with said second shaft.

13. The co-axial crankless engine according to claim 1, wherein the first and second gears attached to said shafts are linked by means to ensure timing synchronisation between the shafts.

14. The co-axial crankless engine according to claim 1, wherein said means is a gear which provides a drive for a power take-off shaft at about 90° to the first and second shafts.

* * * * *